United States Patent [19]

Spencer

[11] 4,424,951

[45] Jan. 10, 1984

[54] BUILDING FORM AND METHOD OF ASSEMBLY

[75] Inventor: Robert B. Spencer, Strongsville, Ohio

[73] Assignee: National Engineering & Contracting Company, Strongsville, Ohio

[21] Appl. No.: 286,365

[22] Filed: Jul. 23, 1981

Related U.S. Application Data

[63] Continuation-in-part of Ser. No. 197,085, Oct. 15, 1980, abandoned.

[51] Int. Cl.[3] ..... E04G 13/02

[52] U.S. Cl. ..... 249/48; 249/162; 425/441

[58] Field of Search ..... 264/31; 249/23, 25, 249/44, 48, 162, 180; 425/441, 451.4

[56] References Cited

U.S. PATENT DOCUMENTS

| | | | |
|---|---|---|---|
| 3,565,390 | 2/1971 | Beasley | 249/180 |
| 3,705,220 | 12/1971 | Ecker | 264/31 |
| 3,815,851 | 6/1974 | Girard | 249/121 |
| 3,857,540 | 12/1974 | Ecker | 264/31 |
| 3,917,216 | 11/1975 | Plough | 249/48 |
| 4,003,543 | 1/1977 | Doubleday | 249/48 |
| 4,123,034 | 10/1978 | Crunk et al. | 249/156 |
| 4,131,405 | 12/1978 | Moore | 425/143 |

*Primary Examiner*—John A. Parrish

*Attorney, Agent, or Firm*—Porter & Associates Co.

[57] ABSTRACT

A building form into which concrete may be poured to form a column or similar structure includes a plurality of stacked form units having interconnected expandable and contractable joints. The application of a vertically upward force to the joints of the uppermost form unit causes all the units to move together, first laterally outwardly and then upwardly to strip the form from the column. The form thereafter may be moved to another location where the joints of the form units may be contracted to provide a form for pouring another column. The joints include movable portions which are cammed outwardly or inwardly depending on the direction of vertical movement of a central, vertically movable portion. The camming action occurs by the action of cams carried by the vertically movable portion urging cam followers mounted on the movable portions to move side members of the form units away from the column when the form is being stripped from the column, and to urge the side members inwardly when the form is being moved to a position where another column is to be poured. The form according to the invention eliminates the need to remove a plurality of fasteners on each form unit prior to removal of the form from the column, and it also eliminates the need to reinsert a plurality of fasteners in the form units to reassemble the form. The entire form-stripping, form-movement, and form-reassembly technique can be carried out by the application of a vertical force from a mechanism such as a conventional erecting crane.

25 Claims, 26 Drawing Figures

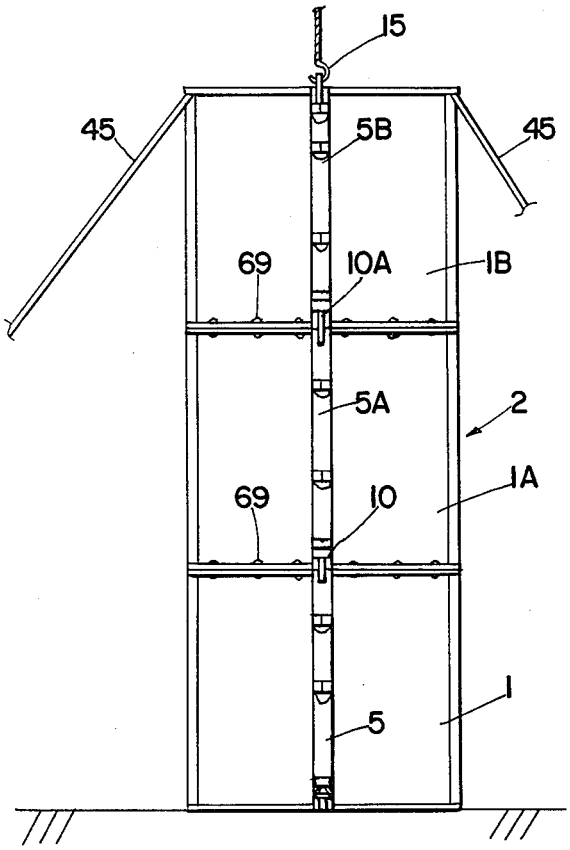
Fig. 2
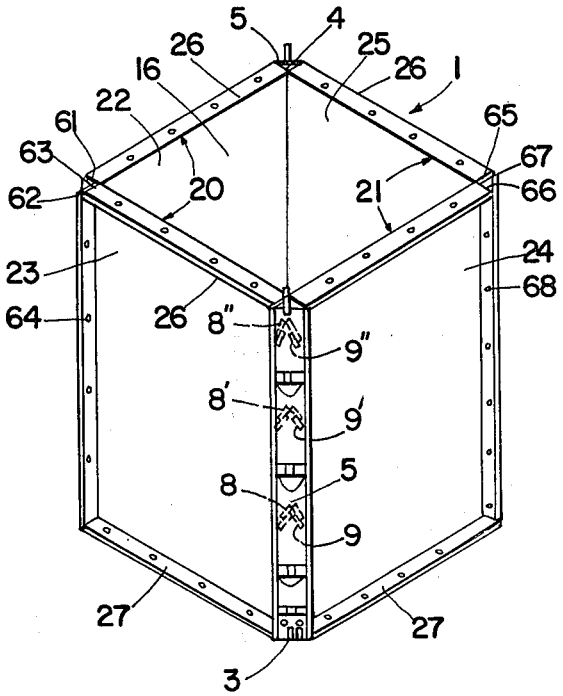
Fig. 1
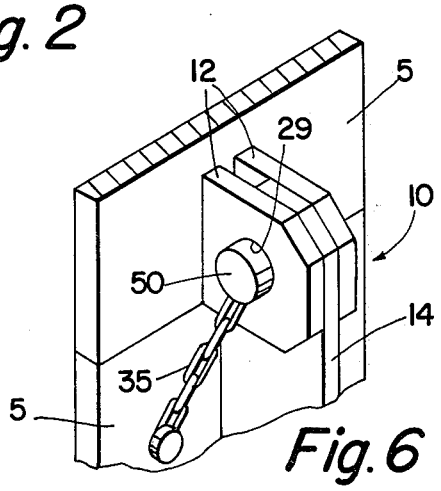
Fig. 6
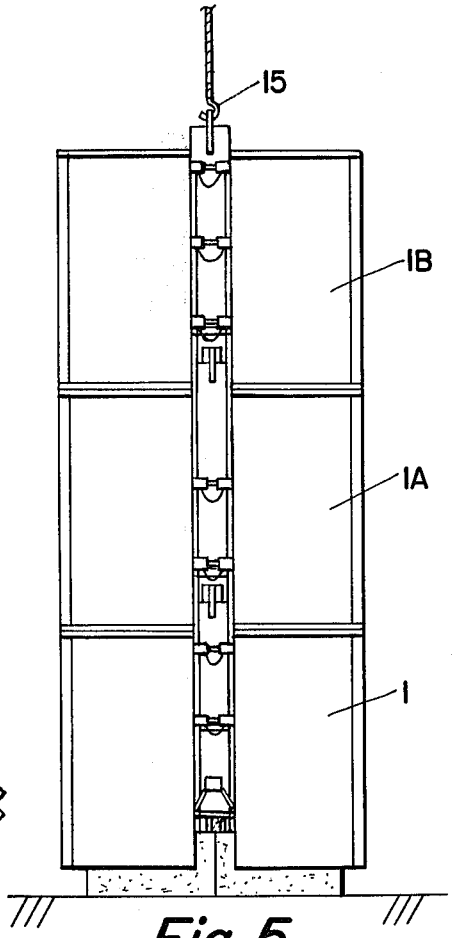
Fig. 5
Fig. 3
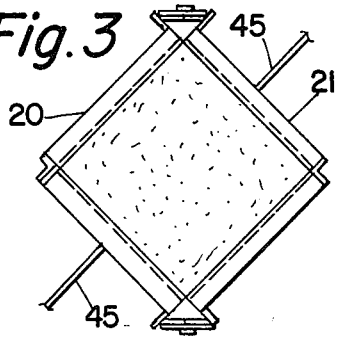
Fig. 4
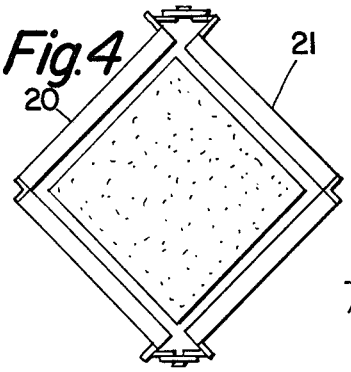

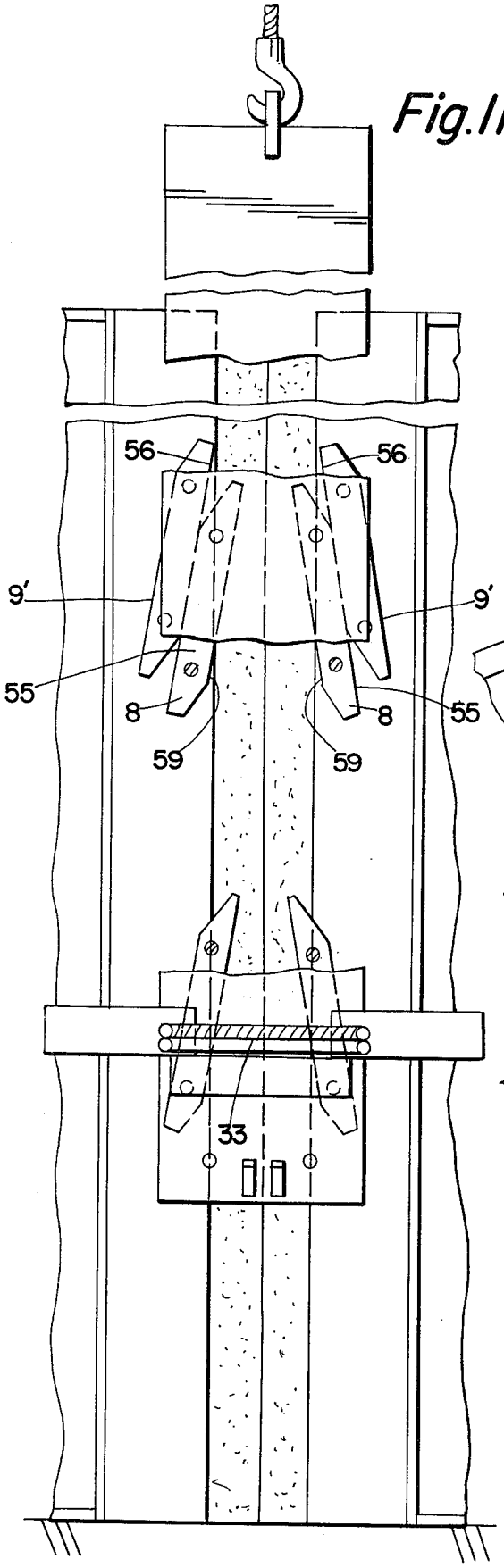
Fig. 11
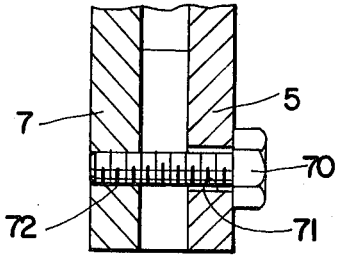
Fig. 13
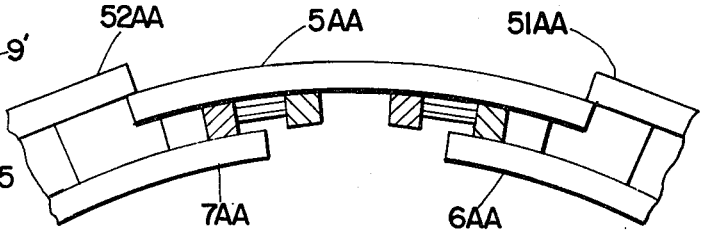
Fig. 15
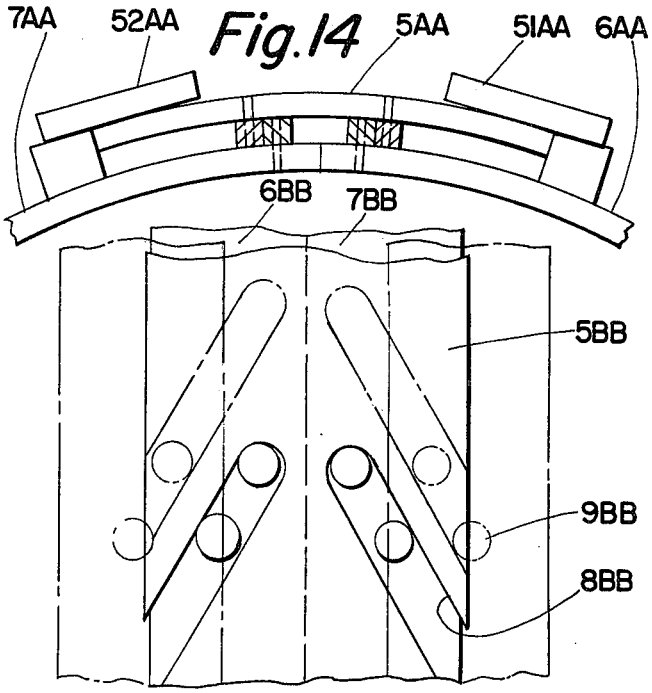
Fig. 14
Fig. 16

BUILDING FORM AND METHOD OF ASSEMBLY

This case is a continuation-in-part of application Ser. No. 197,085, filed Oct. 18, 1980, now abandoned.

BACKGROUND OF THE INVENTION

1. Field of the Invention

The present invention relates to building forms and, more particularly, to metallic forms for making concrete columns, walls, and similar structures.

2. Description of the Prior Art

Concrete columns, such as the type used as supports for buildings, bridges, and the like are made by pouring concrete into a form comprising a plurality of stacked, attached, hollow metallic form units. Each unit is made of half-sections which are attached to each other at their vertically aligned joints by a plurality of fasteners spaced about a foot apart. Since the form assemblies can vary from four to 20 or more feet in height, a considerable number of fasteners are required to be inserted each time an assembly is made. After the concrete has hardened, the fasteners are then removed one by one so that the section halves can be parted from the concrete and moved to a new location for reassembly to provide a form for the next column to be poured. The process of attaching and removing the individual fasteners is time-consuming, results in extensive labor costs, and the materials used in the fastening process, such as nuts and bolts, are easily lost.

While various "quick release" techniques employing elements such as pins, wedges, sliding fasteners, and the like have been used to secure section halves in place, they have had the disadvantage that they still have to be individually removed and replaced, thereby requiring extensive manual labor. In addition, some of the devices have had a problem in achieving a desired positive lock of the forms in place.

SUMMARY OF THE INVENTION

For purposes of simplicity, the invention will be described as employed in the manufacture of concrete columns, although it will be understood that the invention is equally applicable to other concrete structures such as walls, caps, beams, and the like. In accordance with the present invention, a form into which concrete may be poured to form a column includes a plurality of stacked form units having interconnected expandable and contractible joints. The application of a vertically upward force to the joints of the uppermost form unit causes all the units to move together, first outwardly from the column and then upwardly, to strip the form from the column. The form thereafter may be moved to another location where the joints of the form units may be contracted to provide a form for pouring another column.

In a preferred embodiment, the joints are disposed on opposite sides of the form units, and each joint includes movable portions which are cammed outwardly or inwardly, depending on the direction of vertical movement of a central, vertically movable portion. The camming action occurs by the action of cams carried by the vertically movable portion urging cam followers mounted on the movable portions to move side members of the form units away from the column when the form is being stripped from the column, and to urge the side members inwardly when the form is being moved to a position where another column is to be poured, whereby the cams hold the joints closed in preparation for pouring of the next column.

The form according to the invention eliminates the need to remove a plurality of fasteners from each form unit prior to removal of the form from the column, and it also eliminates the need to reinsert a plurality of fasteners in the form units to reassemble the form. Instead, the form can be stripped from the column and reassembled in the next location primarily by the action of a lifting mechanism such as an erecting crane. Not only is such an operation accomplished at a great reduction in manual labor, but the loss of fasteners is greatly reduced or eliminated.

BRIEF DESCRIPTION OF THE DRAWINGS

FIG. 1 is a perspective view of one form unit made in accordance with the present invention;

FIG. 2 is an elevational view of a form employing form units of the type of FIG. 1, with the form erected and concrete poured;

FIG. 3 is a schematic plan view of the form of FIG. 2;

FIG. 4 is a schematic plan view of the form of FIG. 2 illustrating a separation of the form from the column at the start of a stripping action;

FIG. 5 is a front elevational view showing the form of FIG. 2 being partially stripped from the column by the application of an upward force;

FIG. 6 is a perspective view of the connection between vertically movable panels of superimposed form units;

FIG. 11 illustrates the joints of FIGS. 9 and 10, but with the vertically movable panels having reached the point where the laterally outward camming of the laterally movable joint panels is completed;

FIG. 13 is a fragmentary cross-sectional view taken along a plane indicated by line 13—13 in FIG. 9, showing a removable fastener for the bottom of the form, with the fastener in position prior to the pouring of concrete;

FIG. 14 is a fragmentary schematic view of a portion of a modification of the present invention as applied to a form unit having curved walls, and showing a movable joint in a contracted position;

FIG. 15 is a view of the joint of FIG. 14 in an expanded position;

FIG. 16 is a fragmentary, schematic view of a modified cam and cam follower;

DESCRIPTION OF THE PREFERRED EMBODIMENT

Figure 7:
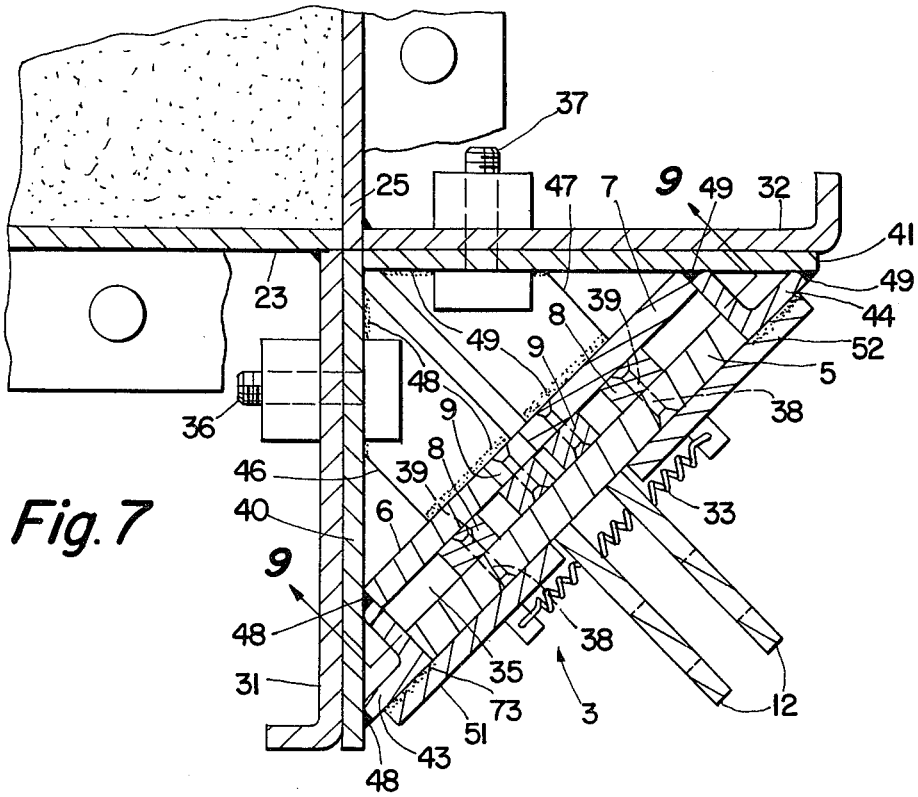
FIG. 7 is an enlarged, fragmentary, partially broken away, cross-sectional view of the near corner of the form of FIG. 2.

Referring to the various FIGURES, a form unit 1 having sides 22, 23, 24, 25 defines an internal cavity 16 into which castable material, such as concrete, is to be poured, to assume the shape of the cavity 16 upon hardening. In the description that follows, use of a prime mark (') and the use of a double-prime mark (") indicates that a given element used in a given form unit is also used in vertically adjacent form units 1; likewise, use of the designations "A" and "B" indicates that substantially identical form units 1 are being used. In accordance with the invention, the unit 1 has oppositely disposed expandable and contractible joints 3 and 4 which movably connect one side member, such as half-section 20, to another side member, such as half-section 21. Each movable joint 3 and 4 includes a vertically movable member, such as panel 5, having a plurality of cam means, such as cam pairs 8, 8' and 8" which engage a plurality of cam follower means, such as cam followers 9, 9' and 9". The cams 8, 8', 8" and the cam followers 9, 9', 9" interact to move laterally movable members, such as horizontally movable panels 6 and 7 (FIGS. 7 and 8), laterally outwardly or inwardly, away from or towards each other, so as to expand or contract the joints 3 and 4 and thereby open or close the form unit 1.

A plurality of the form units 1 may be stacked and connected to each other to provide a multi-unit form 2 by fastening together upper flanges 26 of a given form unit 1 to lower flanges 27 of a superimposed, comparable form unit 1. Form units 1, 1A and 1B in FIG. 2 have been connected in this manner. The vertically movable panel 5 of each form unit 1 also includes lower channel arms 12 adapted to engage an upper tongue 14 included as part of the panel 5 on a vertically adjacent form unit 1. By this construction, panels 5, 5A and 5B of superimposed form units 1, 1A and 1B are interconnected as at 10 and 10A to be simultaneously vertically movable.

In operation, the form 2 is erected as shown in FIG. 2 and concrete is poured to fill the form 2. After the concrete has hardened to form a column (FIG. 3), crane hooks 15 from a crane (not shown) then are applied to the tongues 14 of the joints 3 and 4 of the uppermost form unit 1B. The hooks 15 then are pulled upwardly by the crane in a continuous motion. Such movement, due to the camming action of cams 8, 8', 8" on cam followers 9, 9', 9", first causes the form halves 20, 21 of each unit 1, 1A, 1B to move laterally outwardly to the position of FIG. 4, breaking the contact between the form units 1, 1A, 1B and the column. As shown in FIG. 5, continued upward movement of the hooks 15 then causes the units 1, 1A, 1B to move upwardly and to be stripped from the column. At a new location (not shown), the form 2 can be lowered into place, and the various components of the form 2 will reassume the position shown in FIG. 2. More concrete can be poured into the form 2 to create a new column.

The shape of the form units 1 for use in the present invention will vary with the cross-sectional shape of the column to be formed—such as, for example, round or square. For purposes of illustration, the application of the present invention to a column having a square cross-section will be described in detail. As shown in FIG. 1, the unit 1 comprises a pair of half-sections 20, 21. The first half-section 20 includes a pair of metallic sides 22, 23 fixedly joined at terminal flanges 61, 62 by an angle iron 63 and fasteners 64, as is conventional in the art. The second half-section 21 similarly includes a pair of metallic sides 24, 25 connected at terminal flanges 65, 66 by an angle iron 67 and fasteners 68. Each of the sides 22, 23, 24, 25 has an upper flange 26 and a lower flange 27 whereby the form units 1 can be secured to each other in vertically stacked alignment by the use of fasteners 69, as is known in the art. The section halves 20, 21 are movably joined to each other at opposite corners of the form unit 1 by expandable and contractible joints 3, 4.

Figure 8:
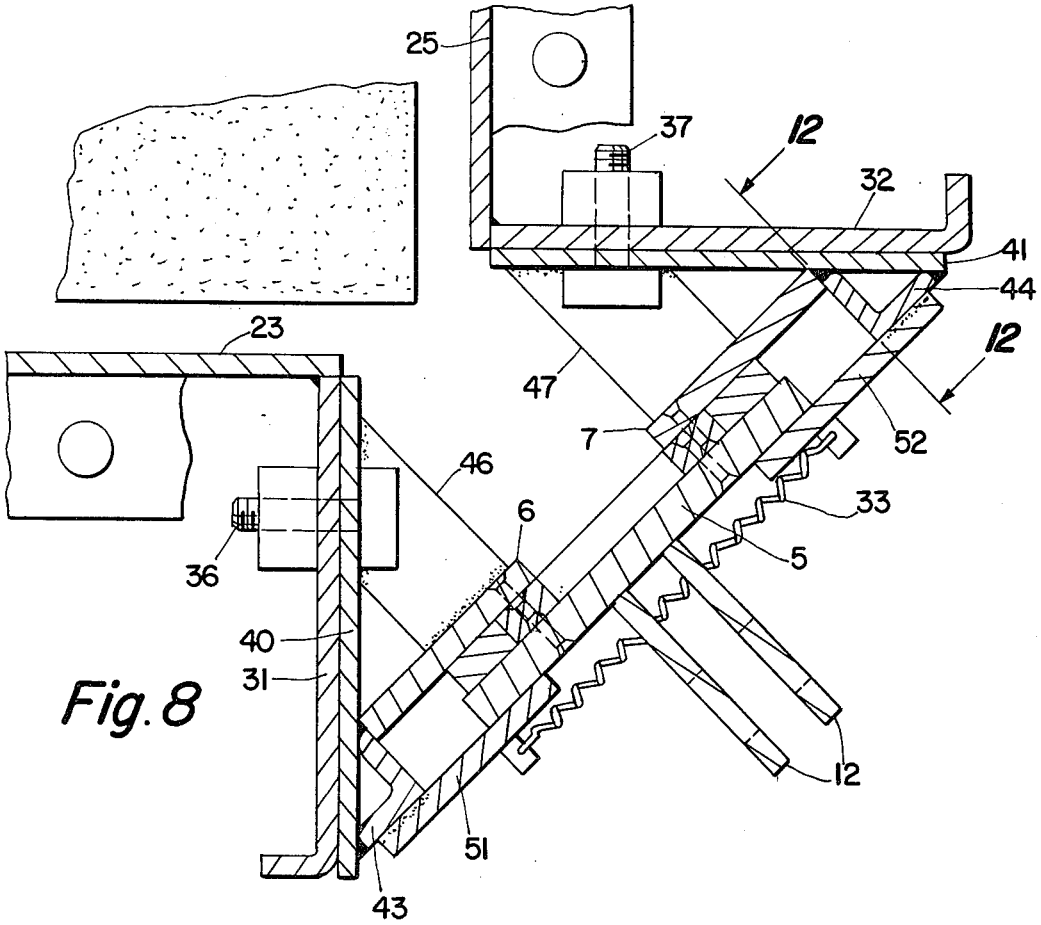
FIG. 8 is an enlarged, fragmentary, partially broken away, cross-sectional view of the near corner of the form of FIG. 5.

Joints 3 and 4 are identical, and thus the structure of only one of them will be described. FIG. 7 illustrates in detail the construction of the joint 3 and its mounting between flanges 31, 32 projecting outwardly of sides 23, 25, respectively. The securement of the joint 3 to the flange 31 is made by a first support plate 40 which is attached to the flange 31 by a plurality of fasteners 36. Similarly, the joint 3 is attached to the opposite flange 32 by a second support plate 41 which is attached to the flange 32 by a plurality of fasteners 37. A first, laterally movable panel 6 is secured to the first support plate 40 by an angle iron 43, a plurality of tab projections 46, and a plurality of weldments 48. Similarly, a second, laterally movable panel 7 is secured to the second support plate 41 by an angle iron 44, a plurality of tab projections 47, and a plurality of weldments 49. By the foregoing construction, the panels 6, 7 will move apart when the form 2 is being stripped from a solidified column, and the panels 6, 7 correspondingly will urge the sides 23, 25 to which they are attached to move away from the column as shown in FIGS. 4 and 8.

Figure 9:
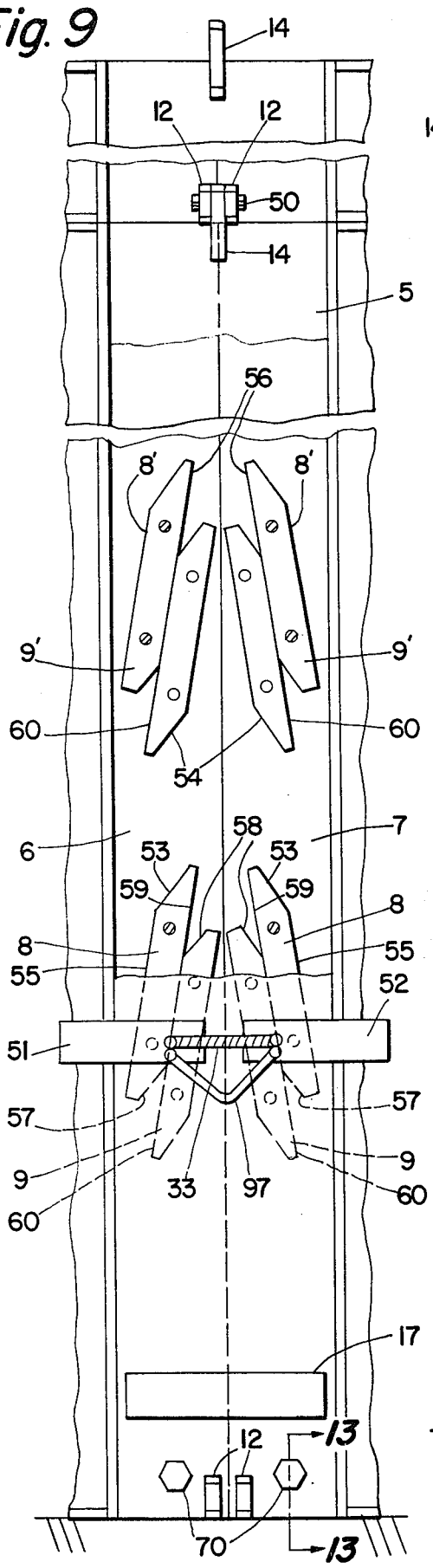
FIG. 9 is a partially broken away, fragmentary, front elevational view of the movable joints of one corner of a form according to the invention taken generally along a plane indicated by line 9—9 in FIG. 7, showing vertically movable joint panels in a downward position, and laterally movable panels in a closed position prior to the pouring of concrete.
Figure 12:
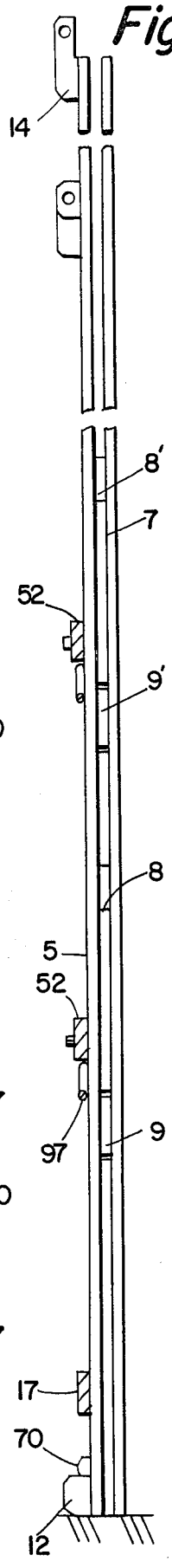
FIG. 12 is a vertical section taken along a plane indicated by line 12—12 in FIG. 8.
Figure 10:
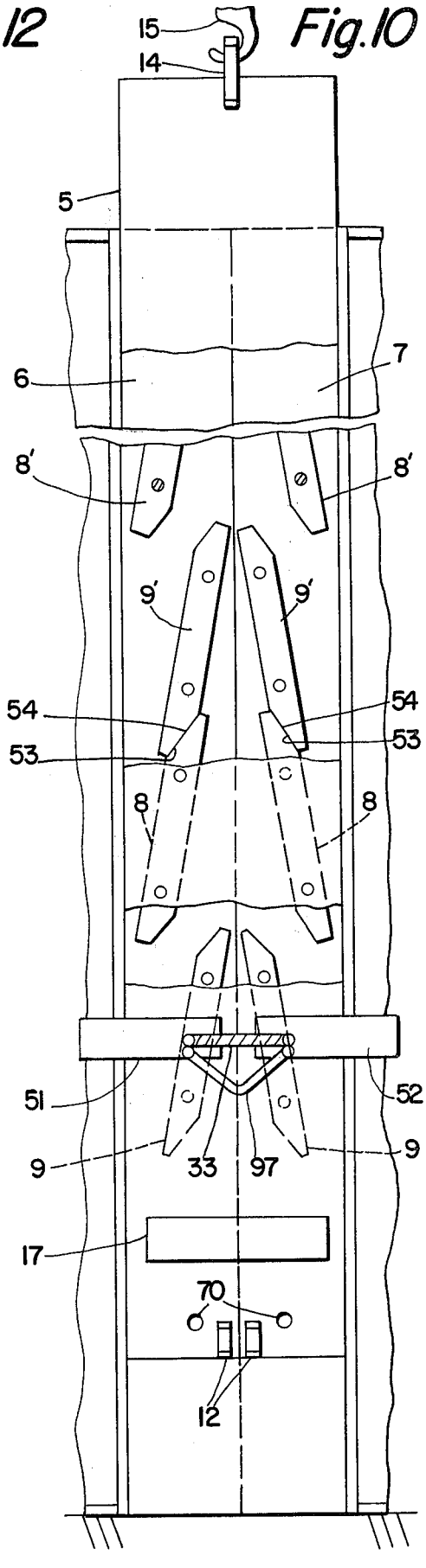
FIG. 10 illustrates the joints of FIG. 9, but with the vertically movable panels being raised to a point where the leading edges of cams have just engaged the leading edges of cam followers at the commencement of a laterally outward camming action.
Figure 17:
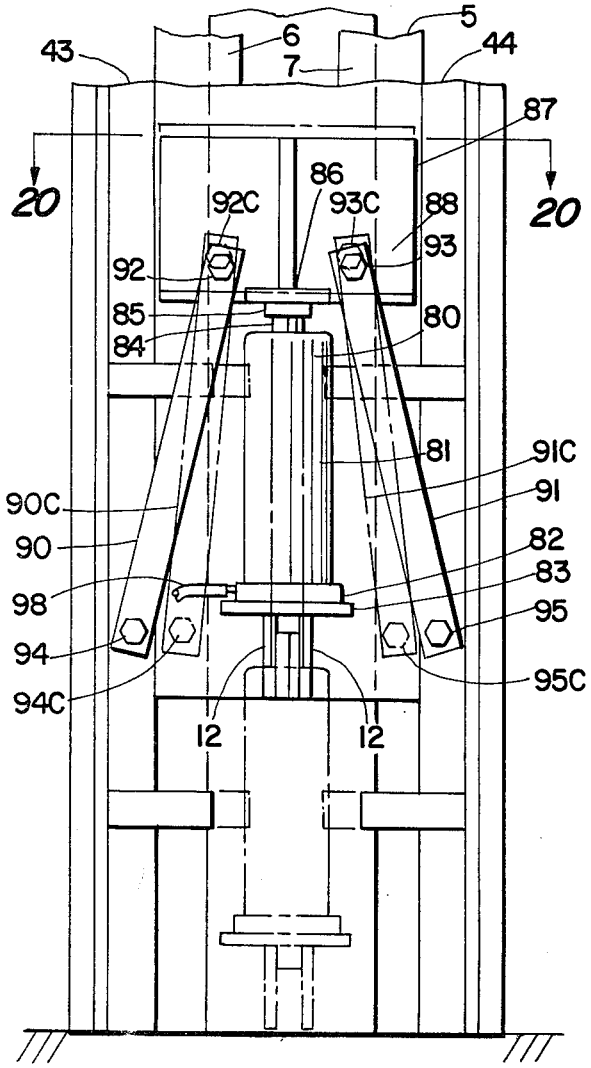
FIG. 17 is a front elevational view of a portion of a form unit showing a modified arrangement of a force-applying mechanism, with the solid lines illustrating the form unit in a partly closed position, and the phantom lines showing the form unit in a fully closed position.

FIG. 7 also shows the mounting of the vertically movable panel 5 relative to the laterally movable panels 6, 7 within the joint 3. The panel 5 has a width equal to approximately the combined width of panels 6 and 7, and is mounted for slidable movement within a vertical channel 35. The channel 35 is defined generally by a plurality of bracket arms 51, 52 projecting from angle irons 43, 44, and which are welded thereto, as by weldments 73. A plurality of cams 8 are attached to the panel 5 by fasteners 38 and provide a vertically sliding engagement between the panel 5 and the confronting faces of the panels 6, 7. A plurality of cam followers 9 are attached to the panels 6, 7 by fasteners 39 and provide a means to interact with predetermined ones of the vertically movable cams 8. As shown in FIGS. 9–11, and as described in more detail hereafter, panels 6 and 7 are cammed laterally outwardly as the panel 5 is moved vertically upwardly.

FIG. 9 shows the mounting of the cams 8, 8' and the cam followers 9, 9' in more detail. While only two cam pairs 8, 8' and two cam follower pairs 9, 9' are shown, it is to be understood that the form 2 in practice will include additional cams and cam followers that operate comparably to those shown. It is preferred that cams 8 and matching cam followers 9 be disposed about every foot in the vertical height of the form 2. For clarity of illustration, a portion of the vertically movable panel 5 is cut away to better show the inter-relationship of the representative cams and cam followers.

As shown in FIG. 9, the cams 8, 8' and the cam followers 9, 9' are mounted so that when the panel 5 is in a lowered position, the panels 6, 7 are in a closed position. The cams 8, 8' are disposed laterally outwardly of the corresponding cam followers 9, 9'. The cams 8, 8' and the cam followers 9, 9' are angled from the vertical to define a generally upwardly facing wedge shape. When the panel 5 is moved upwardly, the cams 8 will move upwardly and inside of the immediately vertically adjacent cam followers 9' so as to cam the panels 6, 7 laterally outwardly. Similarly, when the panel 5 is moved downwardly when the form 2 is positioned at the next location for pouring a column, the cams 8 will be realigned outside of, and in engagement with, the immediately vertically adjacent cam followers 9 so as to cam the panels 6, 7 laterally inwardly. Accordingly, the joint 3 will be closed during the pouring of the concrete.

In order to facilitate the initiation of the camming action, the cams 8, 8' and the cam followers 9, 9' include tapered top and bottom surfaces 53, 54, respectively, which engage each other obliquely at the start of the camming action. It is preferred that the top and bottom surfaces 53, 54 define the same angle with respect to the vertical, and that such angle be between 35 and 40 degrees. This will provide a sufficiently rapid outward movement of the plates 6, 7 to break the seal between the column and the sides 22, 23, 24, 25 of the form 2. The camming action is then completed by contact between laterally outwardly facing camming surfaces 55 of the cams 8 and laterally inwardly facing camming surfaces 56 of the cam followers 9'. It is preferred that the camming surfaces 55, 56 define the same angle with respect to the vertical, and that such angle should be between 8 and 10 degrees. This will provide sufficient laterally outward movement of the plates 6, 7 to achieve sufficient clearance between the column and the sides 22, 23, 24, 25 to permit the form 2 to be lifted from the column.

The cams 8, 8' include bottom surfaces 57 and the cam followers 9, 9' include top surfaces 58 to facilitate camming contact when the panel 5 is moved downwardly into the closing position. It is preferred that the bottom and top surfaces 57, 58 define the same angle with respect to the vertical, and that such angle be between 35 and 40 degrees. This will provide sufficient laterally inward force on the plates 6, 7 to initiate the closing process. The camming action then is completed by contact between laterally inwardly facing camming surfaces 59 of the cams 8, 8' and laterally outwardly facing camming surfaces 60 of the cam followers 9, 9' which provide the means to cam the panels 6, 7 together as the panel 5 descends. The surfaces 59, 60 are generally parallel to the previously described camming surfaces 55, 56.

A stop plate 17 is provided toward the bottom of the form 2. The stop plate 17 is spaced a predetermined distance from the adjacent bracket arms 51, 52, whereby the engagement of the stop plate 17 with the lowest of the bracket arms 51, 52 will prevent further upward movement of the panel 5, and thus prevent further lateral movement of the panels 6, 7. When vertical spacing between the cams 8, 8' is about one foot, the preferred spacing of the stop plate 17 from the lowest bracket arms 51, 52 is about nine inches.

In order to secure the vertically sliding panels 5, 5A, 5B together so that they may move as a unit when a vertical force is applied, a locking arrangement is provided as shown generally at 10 and 10A in FIGS. 2 and 6. The locking arrangment 10, 10A is provided by a channel formed by a pair of projecting arms 12 located at the bottom of each of the plates 5, and a tongue 14 located at the top of each of the plates 5. The arms 12 and the tongues 14 interfit when the form units 1 are stacked atop each other. The arms 12 and the tongues 14 each have an opening as indicated at 29 which register to provide a passageway for receiving a detachable fastening pin 50. The pin 50 may be secured to the panel 5 by a chain 35 to prevent the pin 50 from becoming lost.

The tongues 14 also can provide a means of securing the crane hooks 15 to the plate 5B of the uppermost form unit 1B. While the hook 15 is shown attached only to the tongue 14 of the joint 3, it will be understood that a similar hook 15 will be attached to the tongue 14 of the joint 4. In addition, it may be desirable to attach additional hooks directly to the sides 22, 23, 24, 25 to provide sufficient force for lifting the form 2 vertically after the raising of the panel 5 has brought about the lateral separation of the form units 1 from the column.

Safety chains 97 may be connected to the brackets 51, 52 to assist the stop plate 17 in limiting outward movement of the panels 6, 7. The chains 97 provide a slack portion when the panels 6, 7 are closed, and move outwardly to check lateral movement when the panels 6, 7 are opened.

Figure 18:
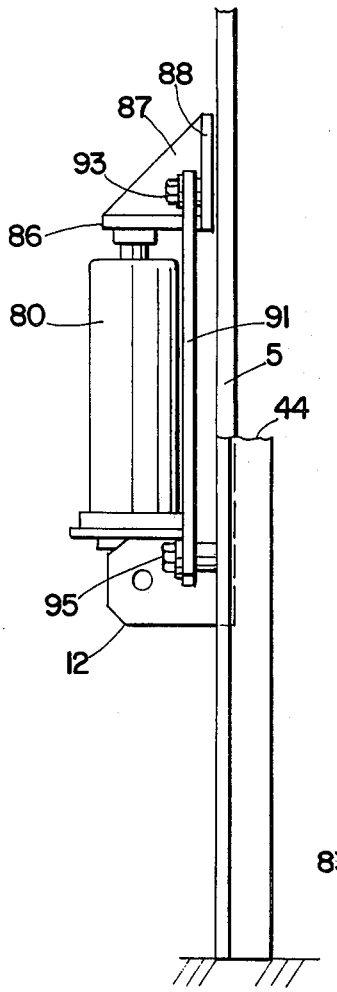
FIG. 18 is a side elevation view of the arrangement shown in FIG. 17 with the form unit in the partly closed position.
Figure 19:
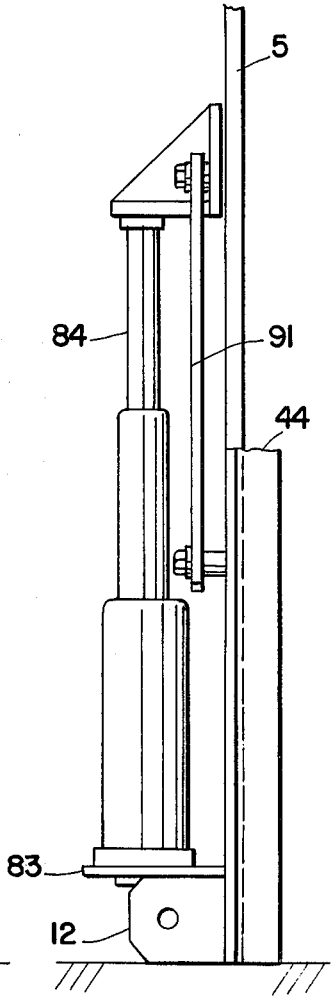
FIG. 19 is a side elevational view of the arrangement shown in FIG. 17, with the form unit in the fully closed position.
Figure 20:
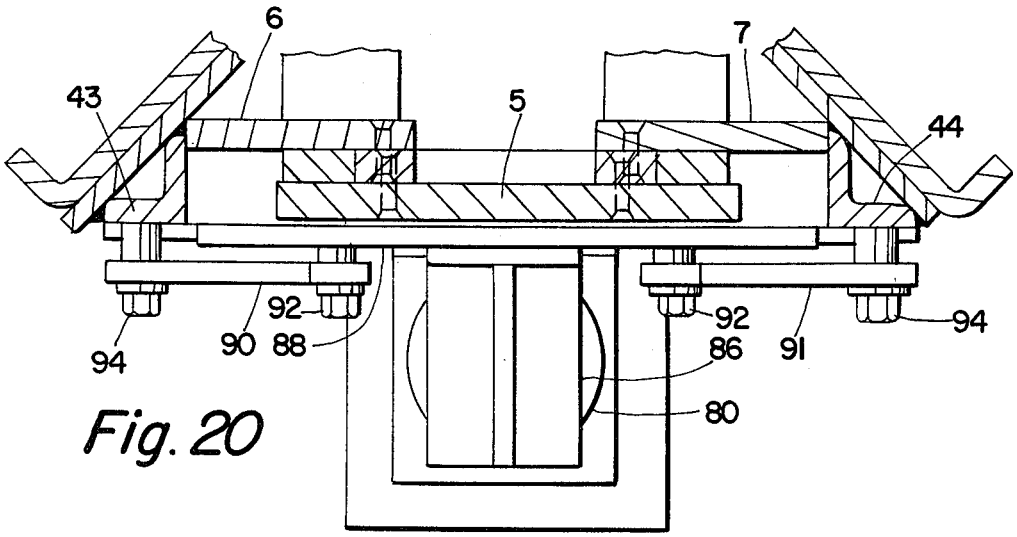
FIG. 20 is an enlarged view taken along a plane indicated by line 20—20 in FIG. 17.

In order to assist in the closing of the panels 6, 7, springs such as 33 may be attached between the bracket arms 51, 52. An additional technique for causing the complete closure of the panels 6, 7 is illustrated in FIGS. 17–20. These FIGURES illustrate an arrangement for utilizing power means to force a closure of the panels 6, 7 in the event that forces greater than that exerted by the springs 33, by gravity acting on the panel 5, or by manual pressure acting on the panel 5 are necessary. Such arrangement comprises a jack 80 which may be manually operable and which is so positioned as to exert a downward force against the panel 5 so as to cause the panels 6, 7 to be cammed towards each other to move the form halves 20, 21 to the closed position. The downward force required to close the form halves 20, 21 will vary with the height and weight of the form halves 20, 21, and with the coefficient of friction between the bottom surfaces of the form halves 20, 21 and the top of the supporting surfaces. The jack 80 includes a cylinder 81, the base 82 of which is supported upon a pad 83. The jack 80 also includes a piston 84, the head 85 of which engages a pad 86. The pad 83 is affixed to a pair of the arms 12 connected to the panel 5. The pad 86 forms the base of an angle bar 87, the vertical face 88 of which extends laterally between, and is carried by, the angle bars 43, 44. The face 88 has a slight clearance with the panel 5, as shown in FIGS. 18–20. The angle bar 87 is operably connected to the angle bars 43, 44 by movable bars 90, 91, respectively. The upper ends of the bars 90, 91 are pivotally connected as at 92, 93, respectively, to the vertical face 88 of the angle bar 87. The lower ends of the bars 90, 91 are pivotally connected as at 94, 95, respectively, to the angle bars 43, 44. Thus, when the jack 80 is in the retracted position as shown by the full lines in FIGS. 17 and 18, the form unit 1 is in the open position; but when the jack 80 is in the expanded position as shown by the dotted lines in FIG. 17 and by the full lines in FIG. 19, the form unit 1 is in the closed position. Additionally, in FIG. 17 the changed position of each movable part is shown by broken lines and is identified by the same reference character, but with the suffix "C" added thereto. In the preferred embodiment, the jack 80 is removably mounted, and the jack mounting assembly such as the pads 83, 86, and movable bars 90, 91 are mounted only on the form unit 1 which is to serve as the bottom unit in an assembled form 2.

It is to be understood that the jack 80 may be of any conventional telescopic type, and that conventional means such as hydraulic fluid entering at port 98, or a mechanically operated lever (not shown), or any other suitable means may be provided to operate the jack 80.

For purposes of simplicity of illustration, the jack arrangement has been omitted from FIGS. 9–11. Also, the jack 80 can be omitted and the panel 5 moved downwardly to the closed position by manually applying force to the top of the uppermost panel 5B, but a positive pressure means, such as the jack 80, provides the preferred means of lowering the panel 5.

While a lateral locking does occur by the interaction of the cams 8 and the cam followers 9 when the vertical panel 5 is in its lowermost position, an inadvertent jarring action by the crane during the pouring of concrete may cause some movement of the plates 6, 7. Also, it may be necessary or convenient to assemble a form 2 at one location, and then move it to another location where the pouring is to occur. In such a case, the lifting of the form 2 would cause the form 2 to open during transit from the place of assembly to the place of use. Accordingly, a positive but removable locking means is needed to prevent vertical movement of the panel 5 while the form 2 is being transported to the location of use. A positive locking may be secured by attaching bolts 70 to the lowermost form. To accommodate the bolts 70, the plate 5 includes apertures 71 and the sliding plates 6, 7 include threaded apertures 72, as shown in FIGS. 9 and 13. The bolts 70 may be attached prior to erecting the form 2. After the concrete has hardened, it is a simple matter to remove the bolts 70. The openings 71, 72 may be provided for each form unit 1, but need be used only with the one of the units, presumably the lowermost unit 1.

FIGS. 14 and 15 show an alternative embodiment of the invention as applied to a curved form such as a cylindrical form. The elements are similar to those already described and distinguish primarily in that they are curvilinear in plan view. Elements corresponding to elements of the previously described square cross-sectional form 2 are given corresponding reference numerals with suffixes "AA" attached.

A modification of the camming system is shown in FIG. 16. Elements corresponding to elements of the previously described form 2 are given corresponding reference numerals with suffixes "BB" attached. The vertically movable panel 5BB has camming slots 8BB cut therein. Each laterally movable panel 6BB, 7BB includes pairs of projecting pins 9BB which ride in the camming slots 8BB. The solid lines how the pins 9BB in the closed position, with the laterally movable panels 6BB, 7BB in closed and abutting engagement. The phantom lines show the pins 9BB in the open position, with the panels 6BB, 7BB spaced apart. As the panel 5BB is raised vertically, camming slots 8BB also are moved vertically to provide the camming action to move the pins 9BB laterally outwardly, and thus move the panels 6BB, 7BB to their laterally outward position.

A less expensive, but also less desirable modification of the invention would be to have a form with only one expandable corner, with the other corner being hinged. Such a structure, although operable, would not provide the degree of form unit separation of the disclosed embodiments.

OPERATION

FIG. 2 shows a form 2 consisting of form units 1, 1A, 1B attached to each other as at 69 and ready for pouring of the column. The panels 5, 5A, 5B are in the locked position, and the panels 6, 7 are closed. The form 2 is held in position by guy wires 45. After the concrete is poured, the form 2 will be filled as shown in FIG. 3. After the concrete has hardened, the bolts 70 are removed, the crane hooks 15 are attached to the tongues 14 of the uppermost form unit 1, and the hooks 15 are lifted by the crane to cause the panels 5, 5A, 5B to be displaced upwardly. As shown in FIGS. 9–11, the cams 8 move upwardly to cam the cam followers 9' laterally outwardly, and thus move the panels 6, 7 of the joints 3, 4 outwardly. In turn, the half-sections 21, 22 are separated from the column, as shown in FIG. 4. Further upward movement of the crane hooks 15 cause the entire form 2 to be raised clear of the column. The form 2 is then moved to a new location for pouring of the next column.

When the form 2 arrives at the next location, the crane hooks 15 are removed. Jack 80 (FIGS. 17–19) is inserted between the pads 83, 86 and is activated to cause the panels 5, 5A, 5B to move downwardly, camming the panels 6, 7 laterally inwardly to the closed position. The bolts 70 are then reinserted in the openings 71, 72 in the lowermost form unit 1, and the form 2 is ready for the pouring of the next column. It will be understood that the closing and locking operation could be performed at a convenient location intermediate that of the last column formed and the next column to be formed. The locked form 2 then can be moved, preassembled, to the position where the next column is to formed.

AN ALTERNATIVE EMBODIMENT

Referring to FIGS. 21–26, an alternative embodiment of the invention especially suitable for forming pier shafts for so-called hammerhead caps is shown. Although this embodiment of the invention, like the earlier-described embodiments, can be used with equal facility for the formation of rectangular columns, walls, and the like, the embodiment of the invention illustrated in FIGS. 21–26 is specially preferred for forming shafts or columns that are relatively wide compared to their thickness.

Figure 21:
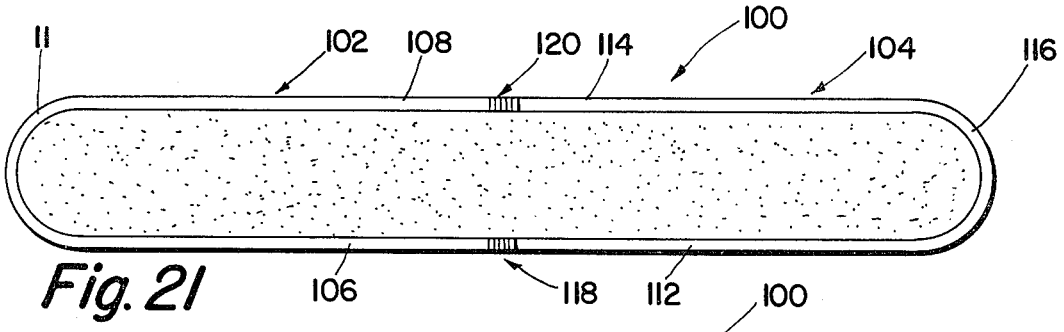
FIG. 21 is a schematic plan view of another form according to the invention.
Figure 22:
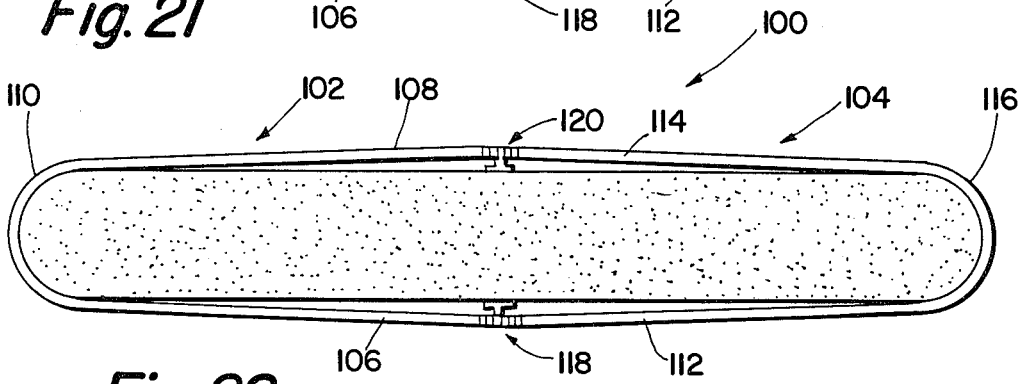
FIG. 22 is a schematic plan view similar to FIG. 21 illustrating a separation of the form from a concrete structure at the start of a stripping action.
Figure 23:
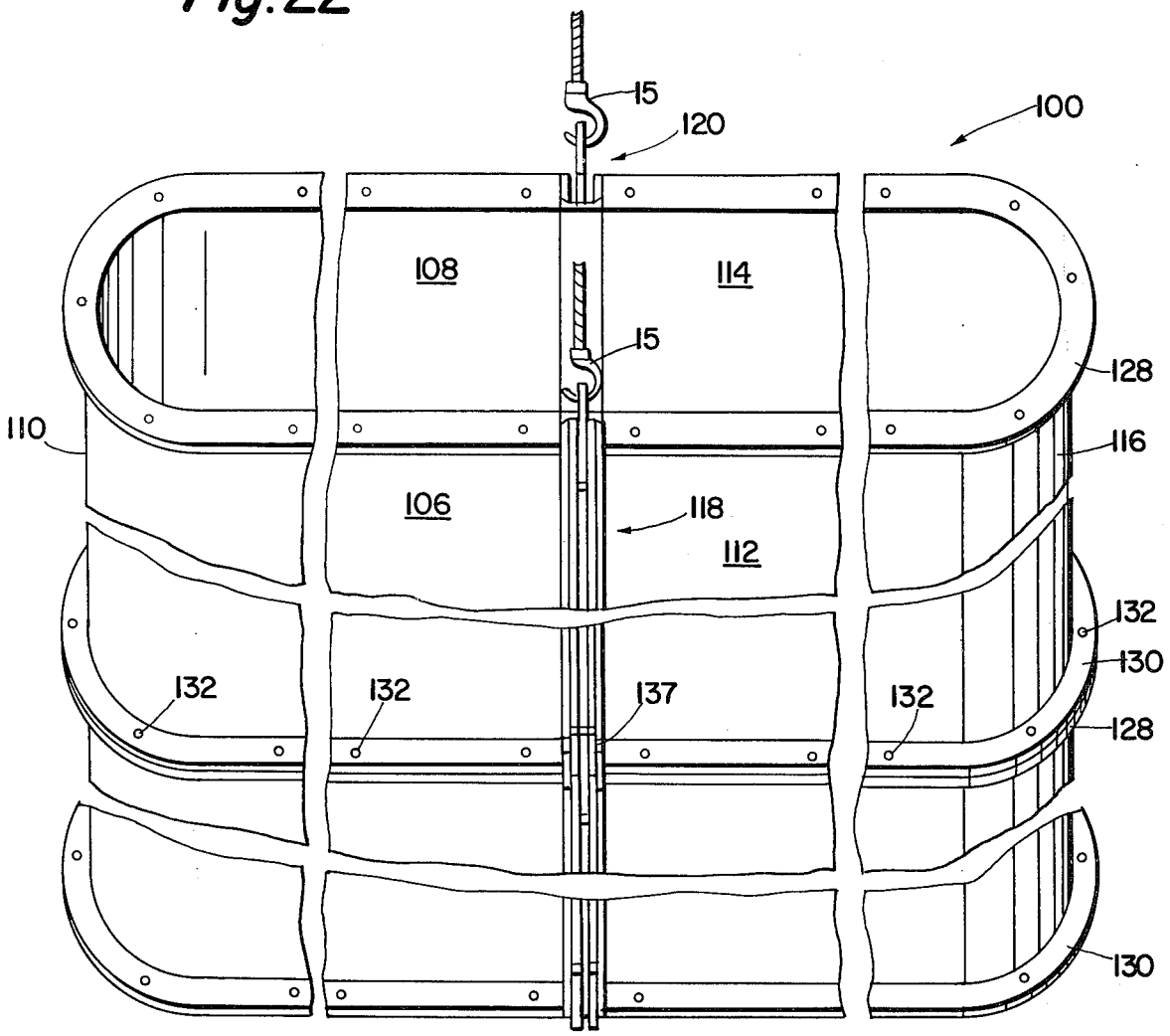
FIG. 23 is a perspective view of the form of FIGS. 21 and 22, with portions broken away and removed for clarity.

Referring particularly to FIGS. 21 and 22, a form unit 100 consisting of half-sections 102, 104 defines a cavity into which castable material, such as concrete, may be poured to assume the shape of the cavity upon hardening. In accordance with this embodiment of the invention, the half-section 102 includes generally flat walls 106, 108 positioned substantially parallel with each other and connected at their ends by a curved end portion 110. Similarly, the half-section 104 includes wall portions 112, 114 and a curved end portion 116.

The unit 100 includes oppositely disposed expandable and contractible joints 118, 120 which movably connect the half-sections 102, 104 to each other. Each movable joint 118, 120 includes a vertically movable, generally T-shaped member 122. The member 122 carries a plurality of cam means, such as cams 124, 124' which engage a plurality of cam follower means, such as cam followers 126, 126'. The cams 124, 124' and the cam followers 126, 126' interact to move the walls 106, 108, 112, 114 outwardly or inwardly, away from or towards the concrete, so as to expand or contract the joints 118, 120 and thereby open or close the form unit 100.

A plurality of the form units 100 may be stacked and connected to each other to provide a multi-unit form by fastening together upper flanges 128 of a given form unit 100 to lower flanges 130 of a superimposed, comparable form unit 100. Form units 100 in FIG. 23 have been connected in this manner by bolted fasteners 132. Each vertically movable member 122 also includes channel arms 134 adapted to be secured to a tongue 136 included as part of the member 122 on a vertically adjacent form unit 100 by means of a bolted fastener 137. By this construction, members 122 of superimposed form units 100 are interconnected so as to be simultaneously vertically movable. The tongue 136 of the uppermost form unit 100 can be engaged by crane hooks 15 as described previously.

Figure 24:
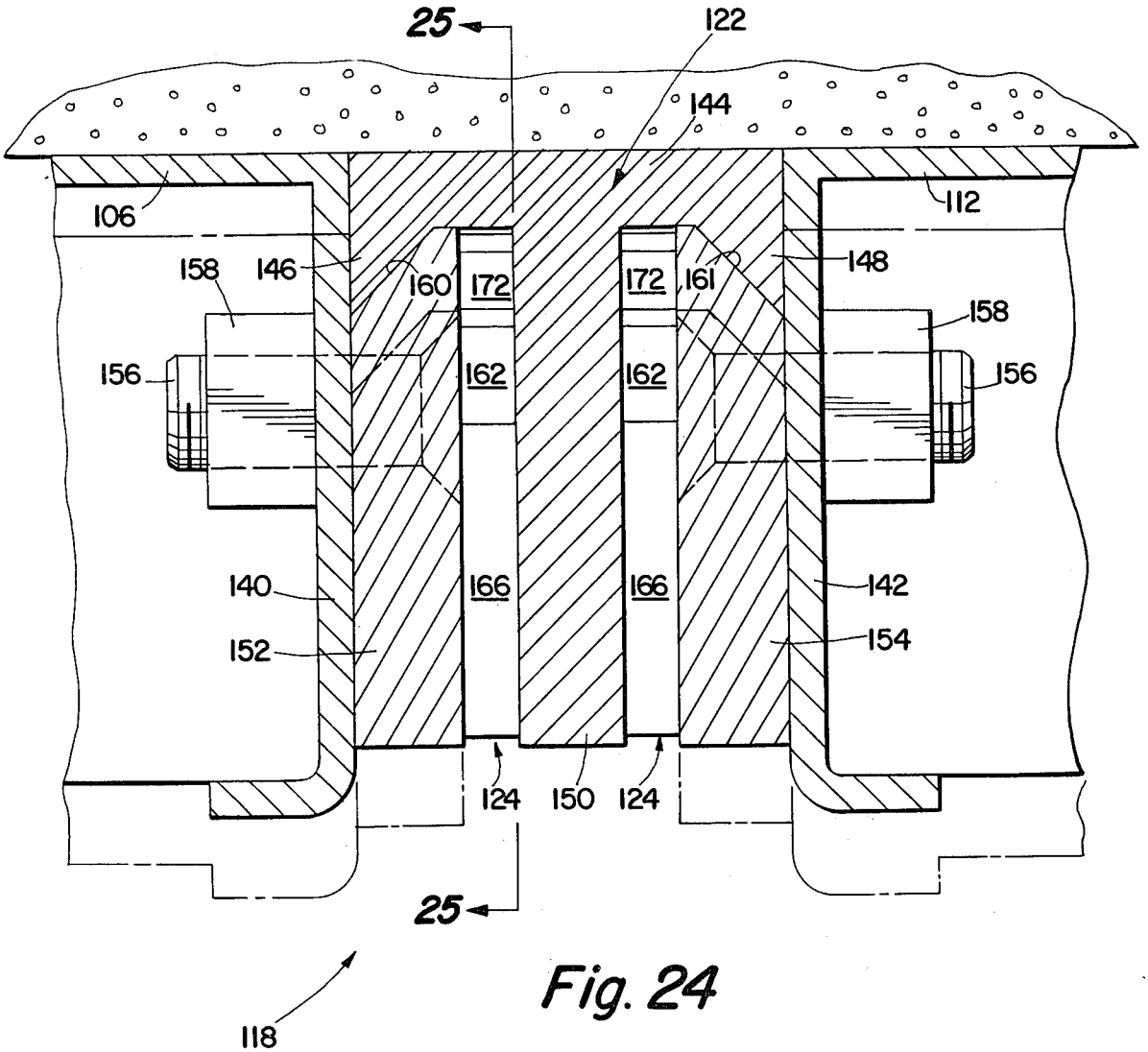
FIG. 24 is an enlarged sectional view of a movable joint connecting portions of the form of FIG. 23.

The joints 118, 120 are identical and the structure of only one of them will be described. FIG. 24 illustrates in detail the construction of the joint 118 and its mounting between flanges 140, 142 extending as a continuation of sides 106, 112, respectively. The joint 118 is very simply constructed, and includes as a principal member the vertically movable, generally T-shaped member 122. The T-shaped member 122 includes a flat-sided crossbar 144 for engagement with the concrete. As can be seen in FIG. 24, the crossbar 144 is, in the joint closed position, a continuous extention of the surfaces defined by the walls 106, 112. The crossbar 144 includes tapered outer edge portions 146 and 148. A central portion 150 is positioned perpendicular to the crossbar 144 and forms the body of the T-shaped member 122. The cams 124, 124' are secured to the central portion 150.

A pair of cam follower support plates 152, 154 are secured to the flanges 140, 142, respectively, by means of bolts 156 and nuts 158. The cam followers 126, 126' are secured to the innter faces of the cam follower support plates 152, 154 for engagement with the cams 124, 124'. The edges of the cam follower support plates 152, 154 positioned closest to the crossbar 144 define beveled edges 160, 161, respectively. The tapered edge portions 146, 148 and the beveled edges 160, 161 tightly engage each other when the joint 118 is in the closed position to securely wedge the components together.

Figure 25:
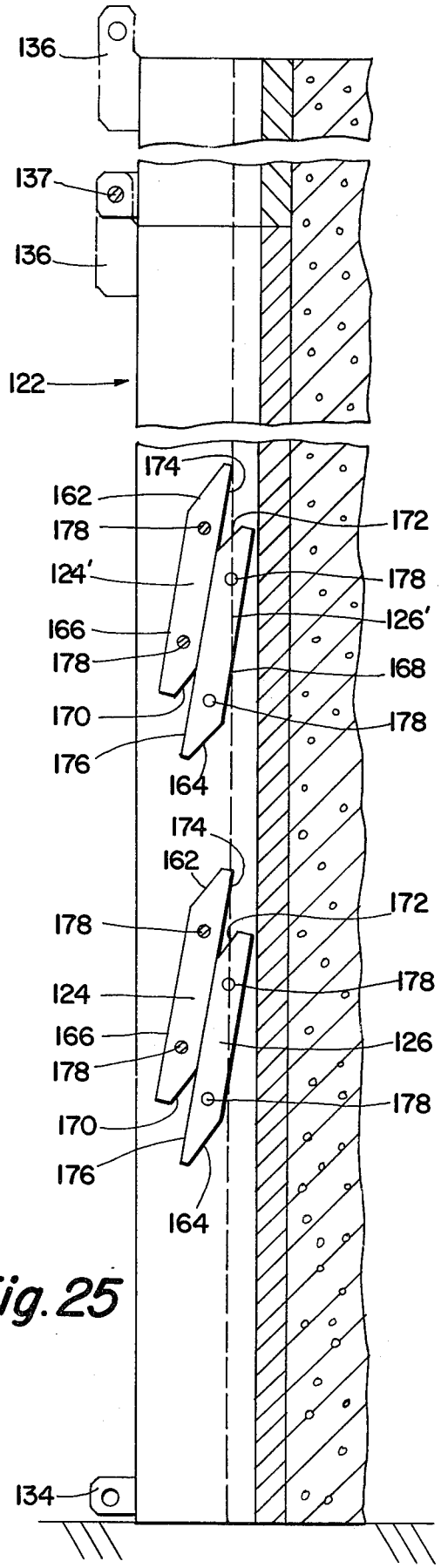
FIG. 25 is a partially broken away view of the movable joint of the form of FIG. 23 taken along a plane indicated by line 25—25 in FIG. 24, showing a vertically movable member in a lowered position, and a movable wall in a closed position.
Figure 26:
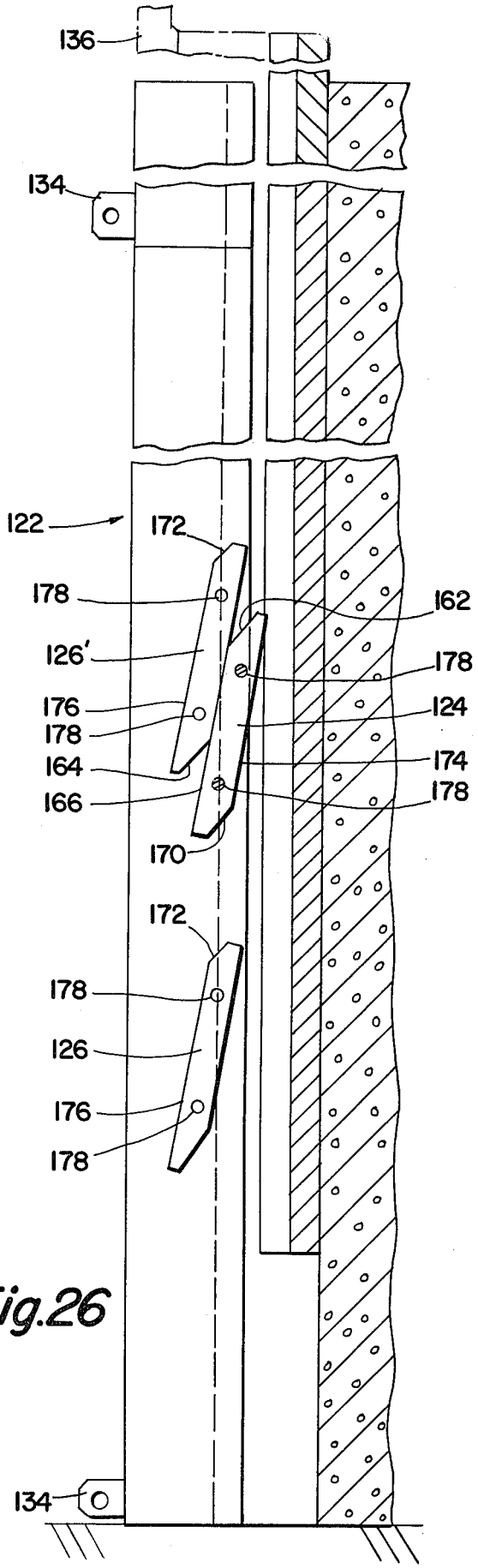
FIG. 26 illustrates the movable joint of FIG. 25, but with the vertically movable member in a raised position and the movable wall in an open position.

FIGS. 25 and 26 show the mounting of the cams 124, 124' and the cam followers 126, 126' in more detail. While only two cam pairs 124, 124' and two cam follower pairs 126, 126' are shown, it is to be understood that the form 100 in practice will include additional cams and cam followers that will operate comparably to those shown. It is preferred that the cams 124 and matching cam followers 126 be disposed about every foot in the vertical height of the form unit 100. For clarity of illustration, a portion of the joint 118 has been cut away to better show the interrelationship of the respective cams and cam followers.

The construction of the cams 124 and the cam followers 126 is substantially identical to the cams 8 and the cam followers 9 previously described. The cams 124, 126 include tapered top and bottom surfaces 162, 164, respectively, which engage each other obliquely at the start of the camming action. It is preferred that the top and bottom surfaces 162, 164 define the same angle with respect to the vertical, and that such angle be between 35 and 40 degrees. This will provide a sufficiently rapid outward movement of the cam follower support plates 152, 154 to break the seal between the concrete and the sides 106, 112 of the form 100. The camming action is then completed by contact between outwardly facing camming surfaces 166 of the cams 124 and inwardly facing camming surfaces 168 of the cam followers 126. It is preferred that the camming surfaces 166, 168 define the same angle with respect to the vertical, and that such angle should be between 8 and 10 degrees. This will provide sufficient outward movement of the plates 152, 154 to achieve sufficient clearance between the concrete and the walls 106, 112 to permit the member 122 to be lifted.

The cams 124, 124' include bottom surfaces 170 and the cam followers 126, 126' include top surfaces 172 to facilitate camming contact when the T-shaped member 122 is moved downwardly toward the closed position. It is preferred that the bottom and top surfaces 170, 172 define the same angle with respect to the vertical and that such angle be between 35 and 40 degrees. This will provide sufficient inward force on the plates 152, 154 to initiate the closing process. The camming action then is completed by contact between inwardly facing camming surfaces 174 of the cams 124 and outwardly facing camming surfaces 176 of the cam followers 126 which provide the means to cam the panels 152, 154 and the T-shaped member 122 together as the T-shaped member 122 descends. The surfaces 174, 176 are generally parallel to the previously described camming surfaces 166, 168. All of the cams 124 and the cam followers 126 are secured to their respective mounting surfaces by means of countersunk fasteners 178.

OPERATION OF THE ALTERNATIVE EMBODIMENT

FIGS. 21, 24 and 25 show the form 100 in the closed position with a shaft already having been poured and solidified. In order to remove the form 100 from the shaft, crane hooks 15 are attached to the tongues 136 of the uppermost form unit 100, and the hooks 15 are lifted by a crane to cause the members 122 to be displaced upwardly. As shown in FIG. 26, the cams 126 have moved upwardly to cam the cam followers 126' outwardly, and thus move the plates 152, 154 away from the concrete. The precise camming action between the cams 124 and the cam followers 126 is substantially identical to that of the cams 8 and the cam followers 9 of the previously described embodiment.

As the members 122 are lifted to that position shown in FIG. 26, the crossbars 144 remain in contact with the concrete, but the walls 106, 108, 112, 114 will be separated from the concrete in the region of the joints 118, 120 (FIG. 22). Due to the length of the walls 106, 108, 112, 114 and due to the configuration of the curved ends 110, 116, the half sections 102, 104 will be flexed sufficiently that contact between the concrete and the half-sections 102, 104 will be broken. Further upward movement of the crane hooks 15 will cause the members 122 to be completely disengaged from the half-sections 102, 104. The half-sections 102, 109 then may be removed individually from the pier shaft and moved to the next location.

When the half-sections 102, 104 arrive at the next location they should be placed in their proper relative positions and then re-connected with member 122 being lowered inside the volume defined by the half-sections 102, 104 to a point about one foot above its final, locked position. The member 122 then can be pushed horizontally into the space between the joints 118, 120 and lowered until the cams 124 and the cam followers 126 are engaged in the locking position. The crane hooks 15 then can be removed.

It has been found that the vertically movable members 122 operate sufficiently easy with respect to the other components of the joints 118, 120 that additional forcing means such as the jack 80 are not needed to close the joints 118, 120, When the members 122 are displaced downwardly, the camming action is the reverse of that described previously, and is substantially identical to that cam action already described with respect to cams 8 and cam followers 9. Eventually that position illustrated in FIGS. 24 and 25 will be attained, whereupon the tapered edge portions 146, 148 will engage the beveled edges 160, 161 so as to securely lock the joints 118, 120 together.

It will be appreciated that the operation of the alternative embodiment of the invention is quite similar in many respects to the operation of the previously described embodiment. A distinction with respect to the earlier-described embodiment is that the flanges 140, 142 are moved away from the cap, rather than laterally away from each other. This is because the cams 124 are mounted on the central portion 150 and the cam followers 126 are mounted on the support plates 152, 154, all of which are positioned perpendicular to the outer surface of the cap. Accordingly, upon displacing the cams 124 and the cam followers 126 relative to each other, the flanges 140, 142 will be moved toward or away from the outer surface of the cap. From a practical point of view, an effective separation of the form 100 from a concrete structure is obtained with use of either the first-described embodiment or the alternative embodiment, but the alternative embodiment requires less force to assemble and disassemble.

Although the invention has been described with a certain degree of particularity, it will be appreciated that the present disclosure of the preferred embodiment has been made only by way of example, and that numerous changes in the details of design and construction may be resorted to without departing from the true spirit and scope of the invention. It is intended that the patent shall cover, by suitable expression in the appended claims, whatever degree of patentable novelty exists in the invention disclosed.

What is claimed is:

1. A form for making concrete structures, comprising:

(a) a first side member defining at least one side of the form and a second side member defining at least another side of the form, the first and second members when connected to each other defining a concrete-receiving volume; and (b) a joint connecting the first and second side members to each other along an edge, the joint having a vertically movable member operably connected to the first and second side members such that movement of the vertically movable member to a first position causes the first and second side members to move relative to the concrete-receiving volume to an open position and movement of the vertically movable member to a second position causes the first and second side members to move relative to the concrete-receiving volume to a closed position.

2. The form of claim 1, further including cam means operably connected to the vertically movable member to cause the first and second side members to move relative to the concrete-receiving volume.

3. The form of claim 2, further including cam follower means operably connected to the first and second side members and positioned to be engaged by the cam means so as to cause the first and second side members to move relative to the concrete-receiving volume upon movement of the vertically movable member.

4. The form of claim 3, wherein:

(a) the joint includes a first movable member connected to the first side member and a second movable member connected to the second side member;

(b) the cam means is mounted on the vertically movable member; and (c) a portion of the cam follower means is mounted on the first movable member, and another portion of the cam follower means is mounted on the second movable member.

5. The form of claim 3, wherein:

(a) the cam means includes a plurality of cam surfaces vertically spaced from each other;

(b) the cam follower means includes a plurality of cam surfaces vertically spaced from each other; and, (c) the cam surfaces of the cam means engage the cam surfaces of the cam follower means to move the cam follower means.

6. The form of claim 3, wherein the cam means and the cam follower means are in the form of pairs of elongate bars inclined relative to the vertical.

7. The form of claim 3, wherein the cam means includes cam surfaces lying in planes oriented generally at right angles to the outer surface of the concrete-receiving volume and the cam follower means include cam surfaces oriented generally at right angles to the outer surface of the concrete-receiving volume whereby, upon movement of the vertically movable member, the first and second side members will be moved laterally toward or away from each other.

8. The form of claim 3, wherein the cam means includes cam surfaces lying in planes oriented generally parallel with the outer surface of the concrete-receiving volume, and the cam follower means includes cam surfaces lying in planes oriented generally parallel with the outer surface of the concrete-receiving volume whereby, upon movement of the vertically movable member, the first and second side members will be moved toward or away from the concrete-receiving volume.

9. The form of claim 8, wherein the vertically movable member is a T-shaped structure, the T-shaped structure includes a central portion oriented generally perpendicular to the outer surface of the concrete-receiving volume, and the cam means is carried by the central portion.

10. The form of claim 9, wherein the side members include portions oriented generally perpendicular to the outer surface of the concrete-receiving volume, and the cam follower means are secured to the perpendicularly oriented portions of the side members.

11. The form of claim 10, wherein the outer portions of the T-shaped structure include tapered edges, and the perpendicularly oriented portions of the side members include beveled sections engageable with the T-shaped structure, whereby, upon displacing the vertically movable member to the second position, the T-shaped structure and the perpendicularly oriented portions will engage each other tightly to lock the joint together.

12. The form of claim 1, wherein the vertically movable member is operably connected to the first and second side members so that movement of the vertically movable member from the first position to the second position is downwardly.

13. The form of claim 12, wherein the operable connection includes:

(a) cam means having a plurality of cam surfaces carried by the vertically movable member;

(b) a first member connected to the first side member and a second member connected to the second side member;

(c) cam follower means having a portion of the cam follower means mounted on the first member and having cam surfaces facing toward the cam surfaces of the cam means;

(d) a portion of the cam follower means mounted on the second member and having cam surfaces facing toward the cam surfaces of the cam means; and, (e) the cam surfaces of the cam means adapted to engage the cam surfaces of the cam follower means to urge the first and second members and their connected side members toward the concrete-receiving volume.

14. The form of claim 13, wherein the cam means and the cam follower means comprise pairs of elongate bars inclined relative to the vertical.

15. The form of claim 1, further including attachment means included as part of the vertically movable member, the attachment means adapted to receive an upwardly applied force to move the vertically movable member.

16. The form of claim 15, further including connection means on the vertically movable member, the connection means adpated to connect to the attachment means of a vertically adjacent form, whereby movement of one of the vertically movable members causes movement of the other.

17. The form of claim 1, wherein:

(a) the form includes a second joint connecting the other edge of the first side member to another edge of the second side member; and, (b) the second joint includes a vertically movable member operably connected to the first and second side members so that movement of the vertically movable member causes the first and second side members to move relative to the concrete-receiving volume.

18. The form of claim 1, including:

(a) a second form, the first and second forms being disposed vertically with respect to each other;

(b) the second form having a first side member, a second side member, a joint connecting one edge of the first side member to one edge of the second side member and having a vertically movable member such that movement of the vertically movable member causes the first and second side members to move relative to the concrete-receiving volume; and, (c) the vertically movable member of the first form being operably connected to the vertically movable member of the second form such that movement of one of the vertically movable members causes movement of the other vertically movable member, whereby the first and second side members of both the first and second forms simultaneously move relative to the concrete-receiving volume upon movement of the vertically movable members of the first and second forms.

19. The form of claim 1, further including jack means operably engaging the vertically movable member, the jack means adapted to exert a force thereagainst sufficient to move the vertically movable member.

20. The form of claim 19, wherein:

(a) a first pad is carried by the vertically movable member;

(b) a second pad is connected to the first and second side members; and, (c) the jack means engages the first and second pads and is adpated to exert force thereagainst.

21. The form of claim 20, wherein:

(a) the first and second pads are disposed in spaced relationship; and, (b) the jack means is positioned intermediate the pads.

22. The form of claim 20, wherein the second pad is connected to the side members by bars, each of the bars being pivotally connected at one end to the second pad, and each being pivotally connected at the other end to the first and second side members.

23. A form for making concrete structures, comprising:

(a) a first side member defining at least one side of the form and a second side member defining at least another side of the form, the first and second members when connected to each other defining a concrete-receiving volume;

(b) a joint connecting the first and second side members to each other along an edge, the joint having a vertically movable member in the form of an elongate plate operably connected to the first and second side members such that movement of the vertically movable member to a first position causes the first and second side members to move relative to the concrete-receiving volume to an open position and movement of the vertically movable member to a second position causes the first and second side members to move relative to the concrete-receiving volume to a closed position;

(c) cam means in the form of bars inclined relative to the vertical secured to the plate at spaced intervals;

(d) cam follower means in the form of bars inclined relative to the vertical connected to the first and the second side members at spaced intervals;

(e) the upper surfaces of the cam means engageable with the lower sufaces of the next vertically adjacent cam follower means upon movement of the plate to the first position, whereby the cam follower means are cammed laterally outwardly; and (f) the lower surfaces of the cam means being engageable with the upper sufaces of the next vertically adjacent cam follower means upon movement of the plate to the second position, whereby the cam means will cam the cam follower means laterally inwardly.

24. A form for making concrete structures, comprising:

(a) a first side member defining at least one side of the form and a second side member defining at least another side of the form, the first and second members when connected to each other defining a concrete-receiving volume;

(b) a joint connecting the first and second side members to each other along an edge, the joint having a vertically movable member having a T-shaped cross-section operably connected to the first and second side members such that movement of the vertically movable member to a first position causes the first and second side members to move away from the concrete-receiving volume to an open position and movement of the vertically movable member to a second position causes the first and second side members to move toward the concrete-receiving volume to a closed position;

(c) cam means in the form of bars inclined relative to the vertical secured to the central portion of the T-shaped member, the central portion of the T-shaped member being positioned generally perpendicular to the surface of the concrete-receiving volume;

(d) cam follower means in the form of elongate bars inclined relative to the vertical, the cam follower means operably connected to the first and second side members and positioned to be engaged by the cam means so as to cause the first and second side members to move toward or away from the concrete-receiving volume upon movement of the vertically movable member between the first and second positions.

25. The form of claim 24, wherein the vertically movable member includes a crossbar having tapered outer portions at its end and the side members include beveled slots engageable with the tapered outer portions whereby, upon moving the vertically movable member to the second position, the tapered outer portions and the beveled slots will tightly engage each other to lock the joint together.

* * * * *